US005820815A

United States Patent [19]

George

[11] Patent Number: 5,820,815

[45] Date of Patent: Oct. 13, 1998

[54] COOLED TAPPING DEVICE

[75] Inventor: David B. George, Salt Lake City, Utah

[73] Assignee: Kennecott Holdings Corporation, Salt Lake City, Utah

[21] Appl. No.: 783,561

[22] Filed: Jan. 15, 1997

Related U.S. Application Data

[60] Provisional application No. 60/010,097 Jan. 17, 1996.

[51] Int. Cl.[6] ..... C21B 7/12

[52] U.S. Cl. ..... 266/45; 266/46; 266/272; 222/592; 222/597

[58] Field of Search ..... 266/45, 46, 271, 266/272; 222/592, 590, 597

[56] References Cited

U.S. PATENT DOCUMENTS

| | | | |
|---|---|---|---|
| Re. 22,479 | 5/1944 | Dobscha | 266/272 |
| 2,294,162 | 8/1942 | Dobscha | 266/272 |
| 2,376,048 | 5/1945 | Giese, Jr. | 266/272 |
| 3,599,953 | 8/1971 | Smith | 266/42 |
| 3,973,761 | 8/1976 | Pelletier et al. | 266/272 |
| 4,273,202 | 6/1981 | Phillips et al. | 266/271 |
| 4,390,170 | 6/1983 | Schaefer | 266/272 |
| 4,471,950 | 9/1984 | LaBate | 266/272 |
| 4,725,045 | 2/1988 | Cutre et al. | 266/230 |
| 4,946,083 | 8/1990 | Fishler et al. | 222/602 |
| 4,995,594 | 2/1991 | Verbik | 266/272 |
| 5,004,130 | 4/1991 | Vaterlaus | 222/590 |
| 5,024,422 | 6/1991 | Fishler et al. | 266/272 |
| 5,071,043 | 12/1991 | Dumazeau et al. | 222/602 |
| 5,259,596 | 11/1993 | Ruffaldi | 266/271 |
| 5,310,166 | 5/1994 | Mast et al. | 266/225 |
| 5,393,038 | 2/1995 | Lonardi | 266/45 |

*Primary Examiner*—Scott Kastler
*Attorney, Agent, or Firm*—Whyte Hirschboeck Dudek SC

[57] ABSTRACT

A cooled elongated, preferably threaded and, tapered, metallurgical taphole plug and a method for using it are described. The plug is inserted into a taphole to cause a plug of molten material to freeze in the taphole such that molten material flow within the taphole is stopped. In one embodiment, the plug is comprised of an externally threaded, elongated member having a first end and a second end with a taper extending at least partially therebetween. The first, narrower end, which is inserted into the taphole, is cooled by a fluid flowing through an internal passage extending at least partially between the first and second ends. As the first end is cooled, the molten material adjacent the first end freezes around the tip of the first end, effectively plugging the taphole. The device is removed by discontinuing fluid flow and applying a rotational moment about the second end such that the threaded, tapered device backsout of the taphole.

15 Claims, 3 Drawing Sheets

COOLED TAPPING DEVICE

This application claims benefit of use Provisional Application No. 60/010,097 filed Jan. 17, 1996.

BACKGROUND OF THE INVENTION

This invention relates to an apparatus and method for stopping the flow of molten material from a taphole in a vessel containing molten material.

Clay or mud is commonly used to close a taphole of a furnace. Typically, clay is introduced under pressure into a taphole, and then the clay hardens to form a plug which stops the flow of molten metal. The plugging of tapholes with clay is an expensive and time consuming process since the mud must be prepared to have the proper consistency and moisture content to avoid explosion. Often several plugs must be prepared in advance for each plugging operation in case one of the plugs does not properly seal the taphole. Furthermore, even after a clay plug has been inserted, there is always a possibility that there will be a subsequent "break out" in which the molten material seeps through and opens up the taphole.

Once a taphole has been plugged, it is equally, if not more, difficult to remove the clay plug. Several devices and methods are well known for accomplishing plug removal. One method utilizes a rotary drill to bore into the taphole plug. Long drill bits are required for this procedure because tapholes are often several feet long. A drawback to this drilling is that the path of the drill bit is difficult to control, especially as the depth of the borehole increases. Additionally, tapholes are typically only a few inches in diameter. Because of the difficulty in maintaining concentric alignment of these drill bits during a taphole drilling operation, these narrow tapholes are often damaged by drill bits as the bits stray off course resulting in damage to the surrounding carbon sleeve and/or refractory wall. Furthermore, drilling is time consuming and often generates undesirable dust.

Another method for unplugging tapholes is the "lost rod" method in which a metal piercing rod is driven into the clay plug before the clay completely hardens. The taphole is opened by extracting the rod from the hardened clay. Although the forceful extraction of the piercing rod is fairly simple, the insertion of the rod into the clay in the taphole is not simple. Typically, the metal rod is inserted using a pneumatic hammer or similar means to thrust the rod into the clay through the application of a strong axial force. Due to the long length of the rod and the rapid hardening of the clay previously introduced into the taphole, such rods have a tendency to buckle and thus become an obstruction in the taphole.

Yet another method of removing a clay plug from a taphole is by the application of a flame generated by an oxygen lance to the clay. A long pipe forming an oxygen lance and made of replaceable sections is used to transmit oxygen, which is ignited at the end of the pipe from which the oxygen exits, to bum through the plug. Typically, this method is used in combination with drilling to burn through the clay remaining after drilling is complete. During this operation, as with the drilling, the carbon sleeve may be severely worn.

U.S. Pat. No. 3,973,761 teaches a method and apparatus for plugging furnace tapholes, the method comprising the steps of blowing air into a taphole with sufficient pressure to reverse the flow of the molten metal within the taphole, and then reducing the pressure to an extent that is sufficient to hold the metal in the taphole without causing it to flow within the taphole in either direction. The apparatus comprises a pipe adapted to be inserted into the taphole to seal the taphole, and means for blowing air into the pipe initially at a first predetermined pressure to reverse molten metal flow in the taphole, and later at a second, reduced pressure sufficient to hold the metal in the taphole. A drawback to this method is that the air pressures for each plugging operation are unique and must be individually calculated based on factors such as the level and density of the molten metal in the furnace. Furthermore, the air pipe used to plug the taphole must be inserted into the taphole quickly to minimize splashing. Finally, the apparatus used to insert the pipe into the taphole and the apparatus used to supply air to the pipe are comprised of numerous parts, and their size interferes with movement around the furnace.

Therefore, an apparatus or device which can be easily be inserted and removed from a furnace taphole is desirable. Preferably, the device can be fully removed from the taphole before flow of the molten metal resumes. Insertion and removal should be achieved through the application of a minimal amount of force without the need for large, force-generating devices. The apparatus should be constructed of a minimum number of parts and require minimal maintenance.

SUMMARY OF THE INVENTION

These and other advantages are achieved through the cooled tapping device of the present invention. This device can be inserted into a taphole of a furnace to cause a plug of molten material to freeze in the taphole such that molten material flow within the taphole is stopped. In one embodiment of this invention, the device is comprised of an externally threaded, elongated member having a first end and a second end with a taper extending at least partially between the two ends. The first, narrower end, which is inserted into the taphole, is cooled by fluid flowing through an internal passage extending at least partially between said first and second ends. As the first end is cooled, the molten material adjacent the first end freezes around the tip of the first end, effectively plugging the taphole. The device is removed by discontinuing fluid flow and applying a rotational moment about the second end such that the threaded, tapered device backs-out of the taphole. Upon removal of the device, the frozen material is melted by the molten material of the furnace and flow through the taphole resumes.

In another embodiment, the device is comprised of an externally threaded, tapered tubular member enclosed by an end wall at each of its first and second ends to define a working chamber. Again, the first, narrower end of the device is inserted into the taphole. The second end of the device protrudes from the taphole and is surrounded and cooled by a standard cooling block. Contained within the chamber is a working substance e.g. water, alcohol, heat transfer fluids, and the like, which evaporates at the first end of the tubular member and flows toward the second end of the tubular member where the working substance condenses and flows back to the first end. A gas pump and/or a liquid pump may be employed to enhance flow of the working substance between the first and second ends. As the working substance evaporates at the first end, heat is removed from the molten substance adjacent the first end until the substance freezes around the tip of the first end. The device is removed and molten metal flow is resumed in the same manner described for the first embodiment.

BRIEF DESCRIPTION OF THE DRAWINGS

In the drawings which illustrate those embodiments which are presently regarded as the best modes for carrying out the invention:

FIG. 5(*b*) is an unthreaded, straight tapping device.

FIG. 5(*c*) is a cross-sectional view of a tapping device with internal and external fins.

DETAILED DESCRIPTION OF THE INVENTION

In the detailed description of this invention, like numerals are employed to designate like parts throughout the same. Various items of equipment, such as fasteners, fittings, etc., are omitted so as to simplify the description. However, those skilled in the art will realize that such conventional equipment can be employed as desired.

Figure 1:
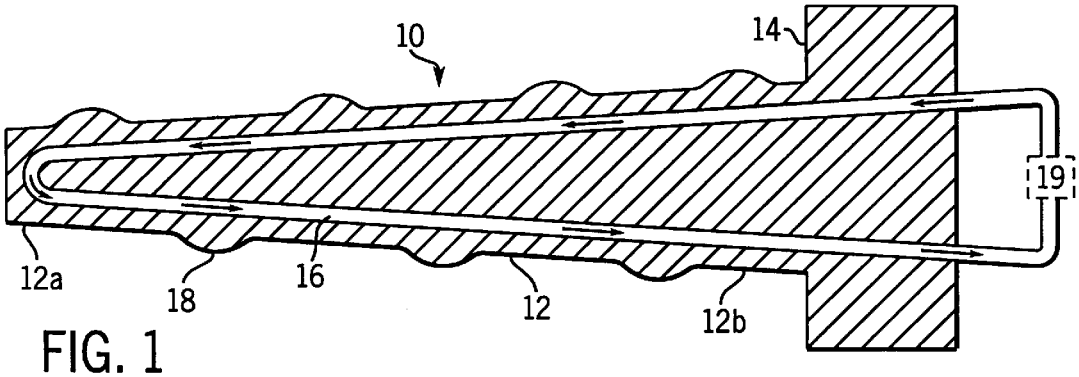
FIG. 1 is a cross-sectional, side elevation view of an externally threaded, cooled tapping device of the present invention.

In FIG. 1, one embodiment of the threaded, cooled tapping device (also known as a "tap" or "plug") is shown and generally designated as 10. Tapping device 10 is comprised of an elongated, cylindrical member 12 having a first end 12*a* and a second end 12*b*. Member 12 is tapered so that the diameter of 12*a* is less than the diameter of 12*b*. Second end 12*b* may also be provided with a shoulder 14. A internal passageway or bore 16 runs within member 12 to allow a cooling fluid (not shown, but comprising any of a number of different materials including but not limited to water, alcohol, organic heat transfer fluids, liquid metals (e.g. sodium), various gases (e.g. air, $N_2$, $CO_2$, etc.)) to be circulated along the length of member 12 by any standard means such as pump 19. Finally, tapping device 10 is provided with external threads 18 disposed along the length of member 12. In the preferred embodiment, threads 12 are of a rounded crest and large pitch and are commonly referred to as "rope threads."

Figure 2:
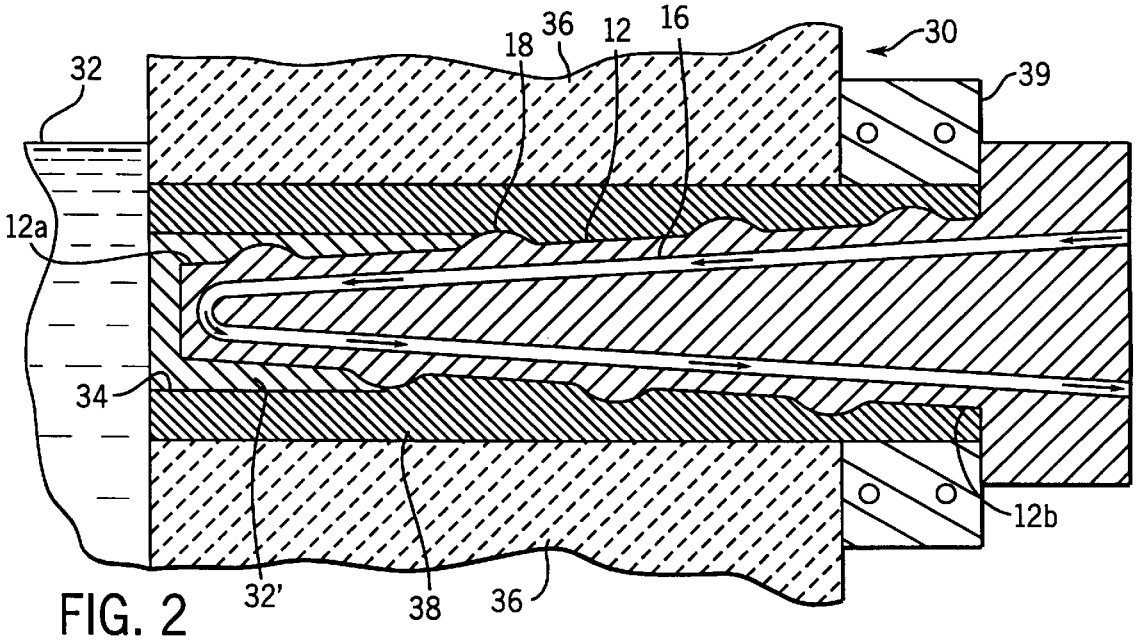
FIG. 2 is a cross-sectional, side elevation view of the device of FIG. 1 inserted into a taphole of a metallurgical furnace.

Turning to FIG. 2, tapping device 10 is shown in use with a metallurgical furnace 30 containing molten material 32. Specifically, device 10 is inserted into a taphole 34 in a refractory wall 36 of furnace 30. Typically, tapholes such as the one shown in FIG. 2 are cylindrical in nature and extend through the refractory from the internal wall of the furnace to the external wall of the furnace. In some instances, the internal diameter of a taphole may be tapered. Additionally, as is common in such tapholes, a graphite sleeve 38 lines taphole 34. In the FIG. 2, graphite sleeve 38 is either internally threaded to mate with threads 12 of device 10, or the sleeve comprises soft graphite which self-taps as device 10 is inserted into it. A cooling block 39 is disposed outside furnace 30 adjacent taphole 34. Those skilled in the art will understand that the structure of furnace 30 is used for illustrative purposes only so that tapping device 10 can be more easily described, and that tapping device 10 is suitable for plugging a taphole in a wide variety of vessels containing molten material.

In one preferred embodiment, the tapping device 10 is tapered so that the external diameter of first end 12*a* is smaller than the internal diameter of sleeve 38, permitting molten material 32 to migrate between at least a portion of first end 12*a* and sleeve 38 when tapping device 10 is inserted into taphole 34. When tapping device 10 is disposed in this manner, circulation of a cooling fluid (not shown) in passageway 16 will cool molten material 32 surrounding first end 12*a*, such that this material adjacent first end 12*a* changes phases to form a hardened plug 32' of material. In one preferred embodiment, cooling block 39 may be provided to permit additional cooling of the fluid within passageway 16. Solid phase plug 32' seals taphole 34, stopping the flow of molten material 32 therethrough. Although not necessary, in the preferred embodiment the cooling fluid is continuously circulated through passageway 16 by pump 19 to ensure that plug 32' remains in a solid phase for the duration of the plugging process. Additionally, plug 32' functions to secure device 10 within taphole 34. Those skilled in the art will understand that an external taper along cylindrical member 12 is preferred, but not necessary. For example, if first end 12*a* is the same diameter as taphole 34, plug 32' is formed by cooling molten material adjacent first end 12*a*, rather than around the tip of first end 12*a*. However, such a configuration may require a greater rate of heat removal than is required when member 12 is tapered.

When taphole 34 is to be opened, tapping device 10 is removed from taphole 34, such that cooling of plug 32' is discontinued. With cooling discontinued, heat from molten material 32 melts plug 32' until plug 32' once again is in a molten phase, at which time flow through taphole 34 resumes. External threads 18 and the taper of member 12 aid in the removal of device 10 from taphole 34. Specifically, these features permit device 10 to be loosened within taphole 34 through only a minimal application of torsion to second end 12*b* by any conventional means. Once device 10 has been loosened within taphole 34, it is easily removed.

Figure 3:
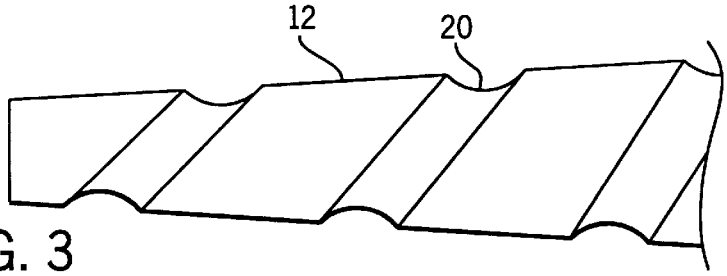
FIG. 3 is a cross-sectional, side elevation view of the device of FIG. 1 in which the external threads are replaced by an external, spiraling groove in the surface of the device.

In FIG. 3, another embodiment of device 10 is shown in which external threads 18 are replaced with an external, spiraling groove 20 disposed along the length of member 12. Groove 20 serves essentially the same function as threads 18 in that molten material 32 can migrate around and into groove 20 such that when material 32 is cooled, device 10 is held fixed within taphole 34.

Figure 4:
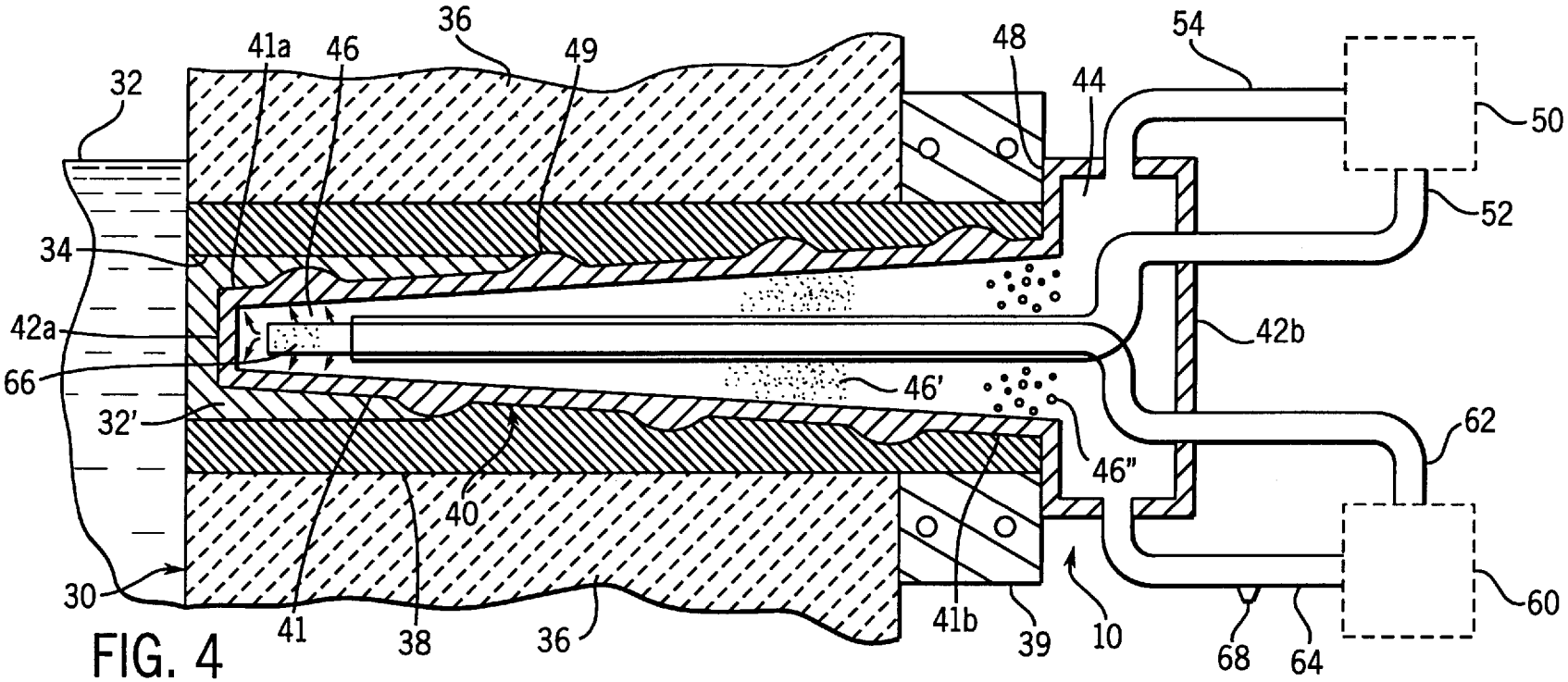
FIG. 4 is a cross-sectional, side elevation view of a second embodiment of the cooled tapping device in which a working fluid is used as a cooling means.

Turning to FIG. 4, another embodiment of the invention is shown and generally designated as 40. Device 40 utilizes the evaporation and condensation of a cooling fluid to remove heat from the molten material such that a plug 32' forms in taphole 34. Device 40 is comprised of an elongated, tubular member 41 having a first end 41*a* and a second end 41*b*. A first end wall 42*a* is attached to first end 41*a* and a second end wall 42*b* is attached to second end 41*b* such that a working chamber 44 is defined therebetween. A working substance 46 (e.g. water, an alcohol, etc.) is contained within chamber 44. Member 41 is tapered so that the diameter of first end 41*a* is smaller than the diameter of second end 41*b*. Additionally, second end 41*b* extends beyond furnace 30 and is adjacent cooling block 39. In the preferred embodiment, device 40 is also provided with a shoulder 48 and external rope threads 49 which extend along the perimeter of member 41.

When device 40 is inserted into taphole 34, working substance 46 evaporates at first end 41*a* and flows to second end 41*b*. Because the inner wall of member 41 adjacent second end 41*b* is cooled by cooling block 39, the gaseous working substance 46 condenses at second end 41*b* along the inner wall of member 41. The liquid from the condensation is directed to flow back to first end 41*a* and the cooling cycle continues.

Although not required, any standard pump may be used to further enhance the flow of working substance 46 through chamber 44. Specifically in FIG. 4, a vapor pump 50 is used to circulate vaporous working substance 46' from first end 41*a* to second end 41*b* where vaporous working substance 46' is condensed into liquid working substance 46'. Once condensed, liquid pump 60 is used to pump working substance 46' back to second end 41*a* where working substance 46" is again condensed. Vapor pump 50 is in fluid communication with device 40 by way of a vapor intake pipe 54 and a vapor discharge pipe 52. Those skilled in the art will understand that vapor pump 50 provides a pressure differential between first end 42*a* and second end 42*b* so that the pressure at first end 42*a* is larger than the pressure at second end 42*b*. This pressure differential drives vaporous working substance 46' to second end 42*b* where the vapor condenses. Liquid pump 60 is in fluid communication with device 40 by way of a fluid intake pipe 64 and a fluid discharge pipe 66. Additionally, device 40 may be provided with a means for recharging working substance 46, such as valve 68 shown on fluid intake pipe 64. In this embodiment, condensed working substance 46" is collected and drawn into pump 60 through fluid intake pipe 64. Pump 60 then delivers condensed working substance 46" back to first end 41*a* through fluid discharge pipe 66. Fluid discharge pipe 66 may also be provided with a screen or nozzle (not shown) to diffuse working substance 46 into droplets which are more easily vaporized.

Figure 5A:
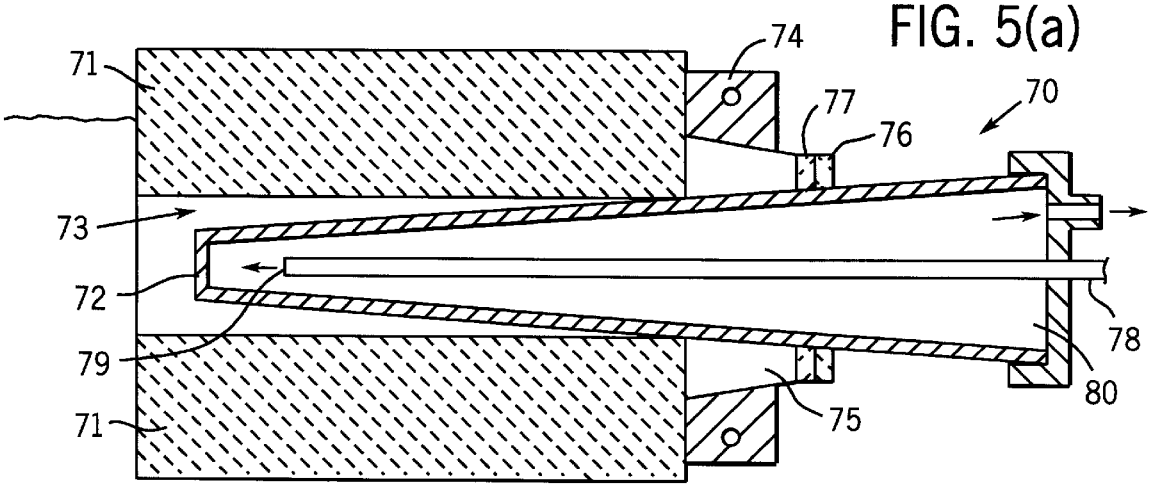
FIG. 5(*a*) is an unthreaded, tapered tapping device inserted into a taphole.
Figure 5B:
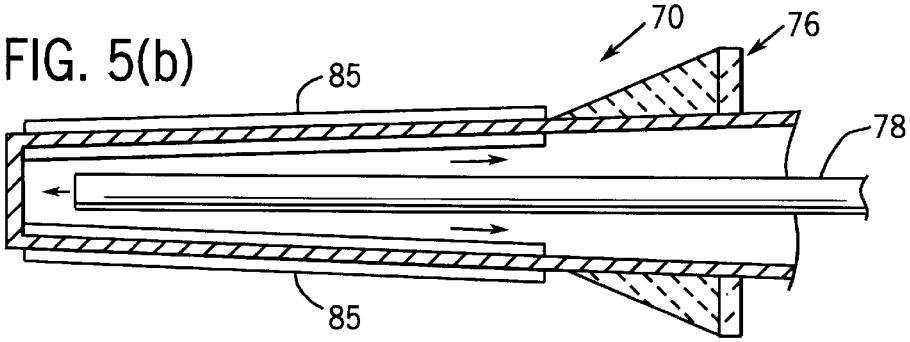
Figure 5C:
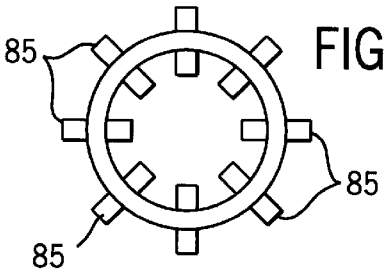

FIG. 5(*a*) describes another embodiment of this invention. In this embodiment, a cooled, unthreaded tapping device 70 is inserted into a taphole 73 such that the flow of molten material is stopped from draining from the taphole while at or near the same time, the flow of coolant within the tapping device freezes the remaining molten material within the taphole. This frozen material in combination with tapping device 70 acts as an effective plug that stops any further flow of molten material from the taphole. Tapping device 70 can be either tapered or straight (not shown), but is sized to extend substantially through taphole 73 with tapered end 72 terminating at or near the inner surface of furnace wall 71. Tapered end 72 is closed or sealed. Tapping device 70 is also sized such that a gap exists between the outer surface of tapered end and the surface defining taphole 73 such that molten material can migrate into and freeze within this gap.

Figure 6:
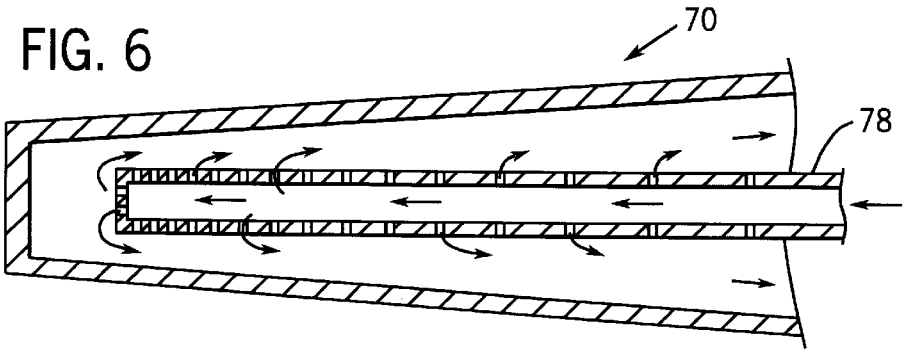
FIG. 6 is a sacrificial, perforated cooling pipe within a tapping device.

A typical external furnace wall, such as that described as furnace wall 71, comprises water cooled tap block 74 with replaceable refractory insert 75. This block and insert surround the taphole. Tapping device 70 is inserted into insert 75 until it firmly seats within it and stops the flow of molten material. Collar 76 is mounted on tapping device 70, and sealing material 77 (e.g. refractory, plastic, etc.) is applied to ring 76 such that when tapping device 70 is inserted into insert 75, the sealing material fills any voids between the tapping device, insert and ring. Cooling supply pipe or line 78 extends coaxially through the substantial length of tapping device 70. This pipe or line carries a cooling media such as water, alcohol, organic heat transfer fluids, liquid metals (e.g. sodium), or various gases (e.g. air, nitrogen, carbon dioxide, etc.). Depending upon the nature of the media and other factors, the heat transfer will be effected by the flowing of the media or by an actual phase change of the media, e.g. from a liquid to a gas. End 79 of cooling pipe 78 is open to allow for circulation of the cooling media back to outlet (not shown) on wide end 80 of tapping device 70. Alternatively, as shown in FIG. 6, cooling pipe 78 is perforated along its length such that the cooling media flow can be controlled to effect the desired level of cooling along the length of tapping device 70. In this regard, the perforations can be grouped or spaced more tightly towards the tapered end of cooling device 70 since more molten material in the taphole is position here.

The tapping devices of this invention are optionally equipped with fins 85 (FIG. 5(*b*) and (*c*)) or other protrusions (not shown) of any configuration (internal and/or external) to enhance cooling. The tapping device can take any one of a number of different configurations, and it can be designed to be either reusable or sacrificial. If the latter, then a typical construction is a copper tube with one end sealed with or without a mounted ring.

In another embodiment of this invention, a heat pipe device can be used as a replacement for cooling pipe 78. In this embodiment, a wicking medium (e.g. ceramic fiber, metal wool, etc.) is used to apply a cooling (or heat transfer) media, preferably of low viscosity, ( e.g. alcohol) to the inner surface of tapping device 70. This media is then circulated to an external condenser to remove heat, and then it is recirculated back to tapping device 70.

Although the invention has been described in considerable detail through the figures and above discussion, many variations and modifications can be made by one skilled in the art without departing from the spirit and scope of the invention as described in the following claims.

What is claimed is:

1. A cylindrical tapping device for plugging a metallurgical furnace taphole, the device comprising:

A) a tapered cylindrical housing having a closed first end and a second end, the housing having a tapered surface extending at least partially from the first end to the second end such that the first end is of a smaller diameter than the second end, the tapered surface comprising an external thread; and B) an internal passage for circulating a cooling fluid at least partially between the first and second ends.

2. The tapping device of claim 1 wherein the thread is a rounded rope thread.

3. The tapping device of claim 1 further comprising at least one cooling fin.

4. A cylindrical tapping device for plugging a metallurgical furnace taphole, the tapping device comprising:

A. a tapered cylindrical housing having a closed first end and a second end the housing having a tapered surface extending at least partially from the first end to the second end such that the first end is of a smaller diameter than the second end, the tapered surface comprising an external, spiral groove; and B) an internal passage for circulating a cooling fluid at least partially between the first and second ends.

5. The tapping device of claim 4 further comprising at least one cooling fin.

6. A tapping device for a metallurgical furnace taphole, the tapping device comprising:

A. a tubular member having (i) a first end and a second end, the first end adapted for insertion into the taphole, and (ii) an external thread extending at least partially from the first end to the second end;

B. a first end wall attached to the first end of the tubular member and a second end wall attached to the second end of the tubular member such that the tubular member and the first and second end walls define a working chamber adpated to hold a cooling fluid; and C. means within the working chamber for transporting the cooling fluid from the second end to the first end, the cooling fluid adapted to evaporate at the first end of the tubular member and flow toward the second end of the tubular member at which the working substance condenses and flows back to the first end.

7. The tapping device of claim 6 in which the means for transporting the cooling fluid from the second end to the first end is a pipe.

8. The tapping device of claim 7 in which (i) the tubular member further comprises a taper extending at least partially from the first end to said second end such that the first end is of a smaller diameter than the second end, and (ii) the pipe further comprises perforations through which the cooling fluid is delivered to the first end of the tubular member.

9. The tapping device of claim 8 further comprising means to enhance the flow of the cooling fluid through the working chamber.

10. The tapping device of claim 9 in which the thread is a rope thread.

11. The tapping device of claim 9 in which the means to enhance the flow of the cooling fluid is a pump attached to the second end of tubular member.

12. A method for plugging a taphole in a metallurgical furnace containing molten material, the method comprising the steps of:

A. inserting the first end of a tapping device comprising:

(1) a tapered cylindrical housing having a closed first end and a second end, the housing having a tapered surface extending at least partially from the first end to the second end such that the first end is of a smaller diameter than the second end the tapered surface comprising an external thread, and (2) an internal passage for circulating a cooling fluid at least partially between the first and second ends, into the taphole such that:

(i) the tapping device engages the taphole in a manner that prevents the flow of molten material from the furnace through the taphole to an area outside of the furnace, (ii) the first end of the tapping device does not extend beyond the taphole into the furnace, and (iii) a gap is formed between the taphole and the first end of the tapping device such that molten material can flow from the furnace into the gap; and B. circulating a cooling fluid within the tapping device until the molten material in the gap freezes.

13. A vessel for molten material, the vessel comprising:

A. a refractory wall with a taphole extending through the wall; and

B. the tapping device of claim 1, 6 or 10 inserted within the taphole such that (i) the tapping device engages the taphole in a manner that prevents the flow of molten material from the vessel through the taphole to an area outside of the vessel, (ii) the first end of the tapping device does not extend beyond the taphole into the vessel, and (iii) a gap is formed between the taphole and the first end of the tapping device such that molten material can flow from the vessel into the gap.

14. A tapping device for a metallurgical furnace taphole, the tapping device comprising:

A. a tubular member having (i) a first end and a second end, the first end adapted for insertion into the taphole, and (ii) an external spiral groove extending at least partially from the first end to the second end;

B. a first end wall attached to the first end of the tubular member and a second end wall attached to the second end of the tubular member such that the tubular member and the first and second end walls define a working chamber adpated to hold a cooling fluid; and C. means within the working chamber for transporting the cooling fluid from the second end to the first end, the cooling fluid adapted to evaporate at the first end of the tubular member and flow toward the second end of the tubular member at which the working substance condenses and flows back to the first end.

15. A method for plugging a taphole in a metallurgical furnace containing molten material, the method comprising the steps of:

A. inserting the first end of a tapping device comprising:

(1) a tapered cylindrical housing having a closed first end and a second end, the housing having a tapered surface extending at least partially from the first end to the second end such that the first end is of a smaller diameter than the second end, the tapered surface comprising an external spiral groove, and (2) an internal passage for circulating a cooling fluid at least partially between the first and second ends, into the taphole such that (i) the tapping device engages the taphole in a manner that prevents the flow of molten material from the furnace through the taphole to an area outside of the furnace, (ii) the first end of the tapping device does not extend beyond the taphole into the furnace, and (iii) a gap is formed between the taphole and the first end of the tapping device such that molten material can flow from the furnace into the gap; and B. circulating a cooling fluid within the tapping device until the molten material in the gap freezes.

* * * * *